United States Patent [19]

Foley

[11] 4,068,556

[45] Jan. 17, 1978

[54] AMMUNITION IDENTIFICATION AND FIRING SYSTEM HAVING ELECTRICAL IDENTIFICATION MEANS

[75] Inventor: Nelson D. Foley, Little Rock, Ark.

[73] Assignee: BEI Electronics, Inc., Little Rock, Ark.

[21] Appl. No.: 765,099

[22] Filed: Feb. 3, 1977

[51] Int. Cl.[2] ..... F41F 3/04; F42C 19/12

[52] U.S. Cl. ..... 89/1.814; 102/70.2 R

[58] Field of Search ..... 89/1.5 R, 1.5 D, 1.5 J, 89/1.814; 102/70.2 R, 70.2 A

[56] References Cited

U.S. PATENT DOCUMENTS 3,814,017 6/1974 Backstein et al. ..... 102/70.2 R

*Primary Examiner*—Stephen C. Bentley

*Attorney, Agent, or Firm*—Burmeister, York, Palmatier, Hamby & Jones

[57] ABSTRACT

The system for electrically identifying and firing ammunition is especially advantageous for firing military rockets from a multiple tube rocket launcher. The system provides an electrical signal for initially identifying the type of rocket or other ammunition loaded and ready to fire in each launching tube. The identifying signal is derived from the firing wire or lead which is also used to fire the rocket. In each rocket an igniter and a diode rectifier are connected in series in the firing circuit which usually extends between the firing lead and a common ground. The diode rectifier is polarized to conduct the firing current while being nonconductive as to the signal current which is oppositely polarized. Each rocket includes an identification impedance having a nature to identify the type of rocket. The different types of rockets have measurably different identification impedances.

18 Claims, 4 Drawing Figures

SIGNAL SUPPLY
FIRING VOLTAGE SOURCE
COMPUTER
DISPLAY

AMMUNITION IDENTIFICATION AND FIRING SYSTEM HAVING ELECTRICAL IDENTIFICATION MEANS

This invention relates to a system for electrically identifying and firing military ammunition. The system may be applied to any type of ammunition, but is especially advantageous for firing military rockets from a rocket launcher having a multiplicity of launching tubes. Such launchers are commonly used on military helicopters and other military vehicles.

In one typical rocket firing system, each rocket is provided with an electrically operable igniter in the form of a small electrical filament or resistance element which is adapted to be heated by the passage of an electrical firing current through the igniter. The heat is employed to fire a primer or squib which ignites the propulsion charge of the rocket. The igniter is connected into a firing circuit which includes a firing wire or lead connected to one side of the igniter, and means for connecting the other side of the igniter to a common ground. The firing lead of each rocket is connected by a suitable connector to the firing control system whereby a firing current can be supplied to each firing lead under the control of the operator.

It is common practice to load several different types of rockets into a multiple tube rocket launcher. For example, such types may include armor piercing rockets, anti-personnel rockets, incendiary rockets and smoke producing rockets.

In order to control the firing of the desired types of rockets, it is necessary for the operator to have information as to the type of rocket which is loaded in each launching tube.

One object of the present invention is to provide a new and improved system for electrically identifying each rocket or other round of ammunition as to its type or character. With such a system it is possible to conduct an electrical inventory of the rockets in all of the launching tubes of a multiple tube rocket launcher, so that the types of rockets and their locations are always known.

A further object is to provide such a new and improved system which identifies the rockets or other ammunition by supplying electrical signals to the firing lead or circuit of each rocket. In this way, no extra connection is needed to each rocket to provide for the electrical identification. Because each rocket can be identified electrically, the different types of rockets may be loaded in a random manner into the various tubes of the rocket launcher. It is not necessary to assign different zones of the rocket launcher to each type of rocket.

To accomplish these objects, the present invention preferably provides a system in which each rocket or other round of ammunition has an igniter, a firing circuit having two terminals, one of which is often grounded while the other terminal often takes the form of a firing wire, a diode rectifier, a firing current path connecting the diode rectifier and the igniter in series between the firing circuit terminals, an identification impedance having a nature to identify the type of rocket, and a signal current path in parallel with at least a portion of the firing current path. The system also preferably includes a firing voltage source for supplying a firing current which is polarized to be conducted by the diode rectifier, a signal source for supplying a signal current of the opposite polarity, switching means for initially connecting the firing circuit to the signal source to identify the rocket and for subsequently connecting the firing circuit to the firing voltage source to fire the rocket, and measuring means connected initially to the firing circuit for measuring the impedance of the signal current path to identify the type of rocket. The measuring means may measure the signal voltage, the signal current or both. Measurably different identification impedances are preferably employed for the different types of rockets. The different identification impedances may have different values of electrical resistance.

Alternatively, the different identification impedances may include Zener breakdown diodes having different values of breakdown voltage.

The signal current path may be in parallel with the entire firing current path and may in some cases include a second diode rectifier, polarized to exclude the firing current, and in series with the identification impedances.

Alternatively, the signal current path may be connected in parallel with the first mentioned diode rectifier, in which case the signal current flows through the igniter and must be of a low value, insufficient to fire the rocket.

In connection with a multiple tube rocket launcher, the system may employ a small computer to measure all of the identification impedances and to maintain an electrical inventory of the different types of rockets which are available in the different launching tubes. The computer can assist in the selection and firing of any desired rocket or rockets, and can also keep track of the rockets which remain in the launching tubes after some of the rockets have been selected and fired.

The computer can include means for firing any desired number of available rockets of each type, as desired by the operator.

In addition to identifying the rockets, the system has an inherent self-testing feature which is unique and useful, in that the system checks the integrity of the firing circuits for all of the rockets. Thus, the system checks the continuity of the firing control wiring to the rocket launchers on the helicopter or other vehicle, the continuity of the rocket launcher wiring, whereby the rockets are connected to the firing control wiring and, in some cases, the continuity of the igniters or squibs on the rockets. The system also detects any short circuits in the firing circuits.

Further objects, advantages and features of the present invention will appear from the following description, taken with the accompanying drawings, in which.

Figure 1:
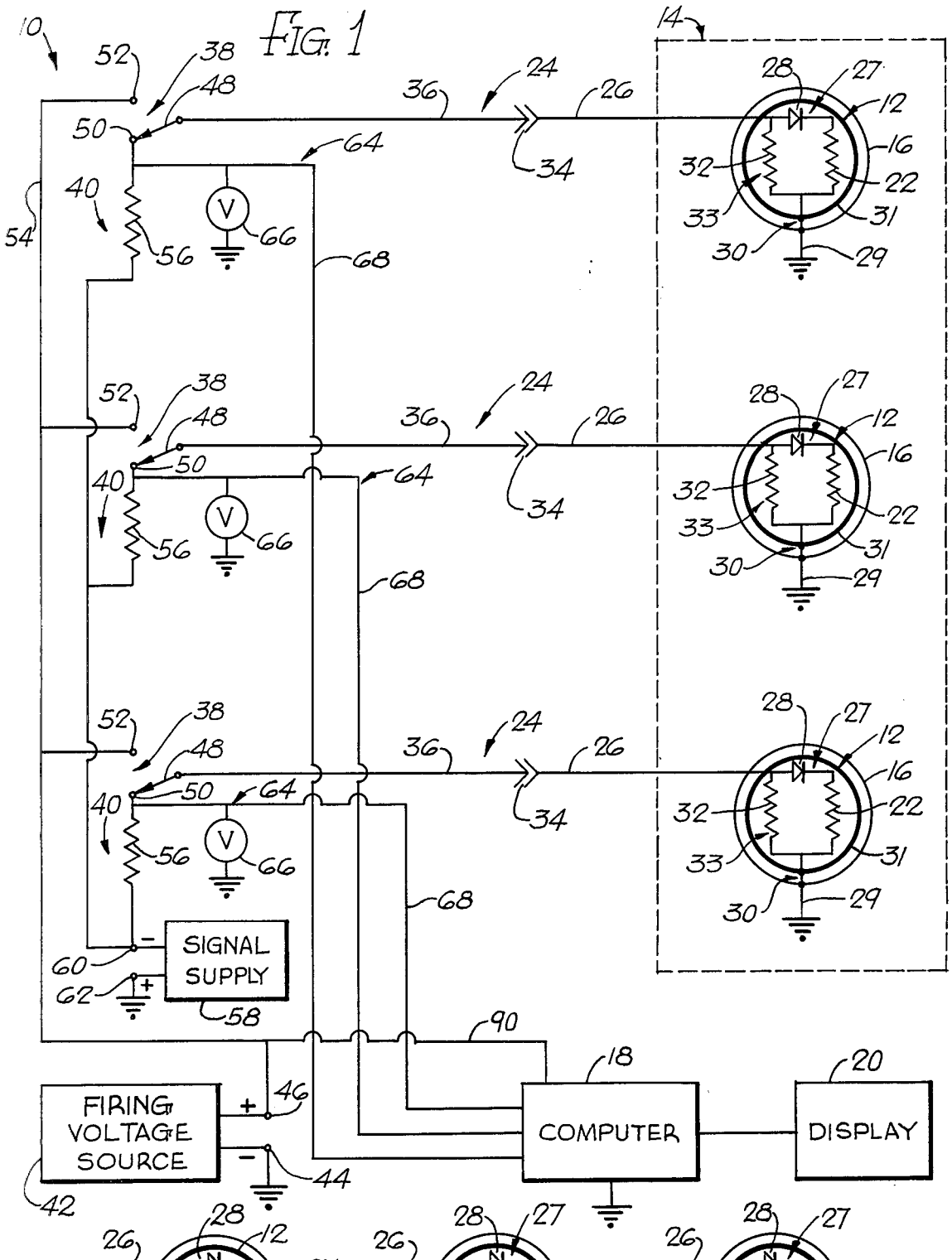
FIG. 1 is a schematic circuit diagram showing an ammunition identification and firing system to be described as an illustrative embodiment of the present invention.

As just indicated, FIG. 1 illustrates an ammunition identification and firing system 10 which is applicable to any type of electrically fired ammunition, but is illustrated, by way of example, as applied to the firing of a plurality of military rockets 12 adapted to be fired from a rocket launcher 14 having a multiplicity of launching tubes 16, only three of which are shown for clarity of illustration. In ordinary practice, the rocket launcher 14 may have as many as 24 rocket launching tubes 16, or even more. Rockets of several different types may be carried in the rocket launcher 14, such as armor piercing rockets, anti-personnel rockets, incendiary rockets and smoke producing rockets. While the different types of rockets may be loaded into different zones allocated to such rockets in the rocket launcher 14, the present invention has the advantage that the different types may be loaded in a random manner, without any need for allocating the different rockets to specific zones. The identification and firing system 10 is capable of identifying each rocket electrically so that a complete inventory of the rocket launcher 14 can be taken electrically. Such inventory may be taken and maintained on a current basis by a small computer 18 having a display 20 indicating the number of rockets of each type which remain in the rocket launcher 14 and are ready to fire. The operator can thus read the display 20 at any time to determine the number of rockets at his disposal. The computer 18 can also be arranged to assist in the selection and firing of any desired number of rockets of each type. It will be taken that the three rockets 12 of FIG. 1 are of three different types.

Each rocket or other round of ammunition 12 has an igniter 22 which is in the form of a small electrical filament or resistance heating element adapted to be heated by the passage of an electrical firing current through the igniter. The heat generated by the igniter 22 ignites the primer charge which in turn ignites the propulsion charge of the rocket 12.

The igniter 22 of each rocket 12 is connected into its own firing circuit 24, illustrated as comprising a firing wire or lead 26. The igniter 22 is connected into a firing current path 27 which also preferably comprises a diode rectifier 28, connected in series with the igniter 22. The firing current path 27 is connected between the firing lead 26 and a common ground 29. Such ground connection may be established by suitable ground means 30 which may include a connection between the firing current path 27 and the metal shell 31 of the rocket 12, and a grounding clip or the like between the metal shell and the launching tube 16. It will be understood that the tube 16 may also be made of metal and may be connected to the common ground 29. It will be evident that the firing lead 26 and the common ground 29 constitute the two terminals of the firing circuit 24, and that the firing current path 27 is connected between such terminals.

Each rocket 12 also includes an identification impedance 32 which is connected into a signal current path 33, connected in parallel with at least a portion of the firing current path 27. In this case, the signal current path 33 is connected between the firing lead 26 and the common ground 29, and thus is connected in parallel with the entire firing current path 27.

The nature of the identification impedance 32 is employed to identify each rocket 12 as to its type. The nature of the impedance 32 can be measured and determined electrically by using a signal or measurement current supplied to the firing circuit 24. The identification impedances 32 for the different types of rockets 12 are measurably different.

Virtually any measurably different set of identification impedances 32 may be employed. As shown in FIG. 1, for example, the identification impedances 32 take the form of resistors or resistance elements having measurably different values of electrical resistance for the different types of rockets. It is easy to measure the different resistance values by causing a signal or measurement current to flow through each identification resistance element 32. The signal current is preferably polarized oppositely relative to the polarization of the diode rectifier 28, so that the signal current does not flow through the igniter 22 and diode rectifier 28. Thus, the diode rectifier 28 prevents the presence of the igniter 22 from interfering with the measurement of the identification resistance element 32.

The firing circuit 24 may also include a suitable connector 34 whereby the firing wire or lead 26 is connected to an additional firing leads 36, extending from the rocket launcher 14 to the control location where the operator is situated. The various firing leads 36 for the multiple rockets 12 in the rocket launcher 14 may be combined in a multi-conductor cable or wiring harness.

The firing circuit 24 for each rocket 12 is provided with switching means 38 for initially connecting the firing lead 36 to a signal source 40 for use in measuring the identification impedance 32 so as to identify the rocket electrically. When it is desired to fire the rocket 12, the switching means 38 may be employed to connect the firing lead 36 to a firing voltage source 42 which provides ample voltage to cause the igniter 22 to fire the rocket 12.

As shown, the firing voltage source has grounded and ungrounded output terminals 44 and 46 which are polarized to agree with the polarization of the diode rectifier 28, so that the rectifier will be conductive as to the firing current.

As illustrated, each of the switching means 38 takes the form of a two-position switch 48 for connecting the firing lead 36 alternatively to terminals or contacts 50 and 52. The terminal 50 is connected to the signal source 40, while the terminal 52 is connected by a lead 54 to the ungrounded terminal 46 of the firing voltage source 42. The switch 48 may be either mechanical or electronic in operation. Various other specific switching means may be employed.

As shown, the signal source 40 comprises a current limiting resistance or other impedance 56 connected in series with a signal voltage supply 58. One side of the illustrated resistance 56 is connected to the swtich terminal 50, while the other side of the resistance 56 is connected to the ungrounded output terminal 60 of the signal voltage supply 58, the other output terminal 62 being grounded. The signal voltage supply 58 is polarized oppositely relative to the diode rectifier 28, so that the diode rectifier 28 will be non-conductive as to the signal current.

The signal voltage supply 58 may produce signals of various types, such as direct current or pulses. As a safety measure, the current limiting resistance 56 preferably limits the signal current to a low value compared with the normal firing current so that the signal has a low energy, insufficient to cause the igniter 22 to fire the rocket 12, even if diode rectifier 28 breaks down and becomes conductive as to the signal current, due to some defect in the diode rectifier.

It is also generally advantageous to give the current limiting resistance 56 a resistance value which is considerably greater than the resistance values of the various identification impedances 32, so that the magnitude of the signal current is determined almost entirely by the resistance value of the current limiting resistance 56.

Each firing circuit 24 also includes indicating or measuring means 64 for measuring the value of the identification impedance 32. The measuring means 64 may be connected to the firing lead 36 and may be responsive to the voltage drop across the firing circuit. Such voltage drop is directly proportional to the resistance value of the identification resistance 32. The signal current through the identification resistance 32 varies very little for the various values of identification resistance 32 because of the relatively high value of the current limiting resistance 56 which basically establishes the signal current.

The signal voltage drop across the firing circuit 24 may be indicated or measured by any suitable voltage indicator 66 which may be either electronic or electromechanical in operation. Thus, the indicator 66 may include an electromechanical voltmeter, an electronic voltmeter or an electronic circuit which produces any suitable type of display, or performs control functions.

As shown, the indicating means 64 also includes a connection 68 to the computer 18, so that the computer 18 can use the signal voltages from the various firing circuits 24 to take an inventory electrically of the types of rockets 12 in the various launching tubes 16 of the rocket launcher 14. The computer 18 includes means for measuring the signal voltage drop across each firing circuit 24 so as to measure each of the identification resistances 32.

It will be understood that various other suitable means may be employed to measure the values of the identification resistances 32. For example, each identification resistance 32 may be measured by supplying a known signal voltage to each firing circuit 24 and then measuring the signal current which is supplied by the signal source to the firing circuit.

After any rocket 12 has been fired, its firing circuit 24 will be open. The full voltage of the signal voltage supply 58 will appear across the firing circuit 24 when the switch 48 is in its signal position engaging the contact 50. The measuring means 64 will show the full signal voltage which will be taken as an indication that the rocket has been fired.

In maintaining its inventory of available rockets 12, the computer 18 will remove the fired rockets from the inventory. It will be understood that the computer 18 may have memory devices for keeping track of the number of rockets of each type remaining in the rocket launcher 14.

Figure 2:
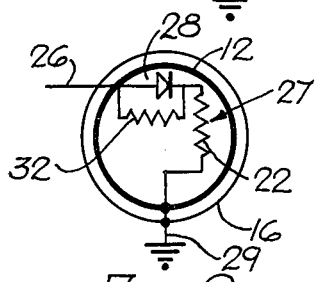
FIGS. 2, 3 and 4 are fragmentary schematic circuit diagrams showing modified constructions.

FIG. 2 illustrates a modified construction in which the identification impedance 32 in the rocket 12 is connected in parallel with only a portion of the firing circuit 27. Specifically, the identification impedance 32 is connected in parallel with the diode rectifier 28. With this arrangement, the signal current flows through the identification impedance 32 and the igniter 22 which are effectively in series to form the signal path across the firing circuit 24. The signal current must be limited to a low value which is insufficient to cause the igniter 22 to fire the rocket 12. This is easily achieved by assigning a high resistance value to the current limiting resistor 56.

For the modification of FIG. 2, the measuring means 64 measures the combined resistance value of the identification resistance 32 and the igniter 22, connected in series. Ordinarily, the identification resistance 32 has a substantially higher resistance than that of the igniter 22. As before, the identification resistance 32 has measurably different resistance values for the different types of rockets which are to be identified.

Some or all of the rockets 12 of FIG. 1 may be replaced with the modified rockets of FIG. 2. Otherwise the system 10 of FIG. 1 remains unchanged.

Figure 3:
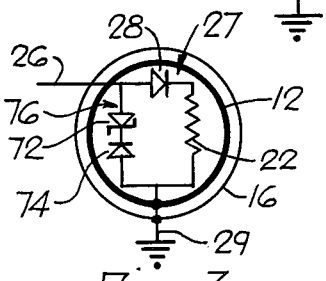

FIG. 3 illustrates another modified construction in which the rocket 12 has a modified identification impedance 72 in the form of a Zener breakdown diode. As shown, a second diode rectifier 74 is connected in series with the breakdown diode 72 to form a signal current path 76 between the firing lead 26 and the common ground 29. Thus the signal path 76 is connected in parallel with the firing current path 27 and directly across the firing circuit 24.

The second diode rectifier 74 has an opposite polarization relative to the polarization of the first diode rectifier 28 in the firing current path 27. Thus the second diode rectifier 74 is non-conductive as to the firing current, while conductive as to the signal current. The Zener diode 72 is polarized so as to be broken down by the signal voltage. For the different types of rockets, different Zener diodes are employed having measurably different breakdown voltages to identify the rockets.

Rockets 12 of the modified construction shown in FIG. 3 can be substituted for some or all of the rockets 12 as shown in FIG. 1. Measuring means 64 are then employed to measure the different breakdown voltages of the Zener diodes 72 for the various types of rockets. The signal voltage provided by the signal supply 58 should be great enough to break down all of the Zener diodes 72. In each firing circuit, the resistor 56 limits the current through the Zener diode 72 when it is broken down. The signal voltage across the firing circuit 24 then corresponds to the breakdown voltage of the Zener diode 72. Zener diodes of various breakdown voltages are readily available for use in the different types of rockets.

Figure 4:
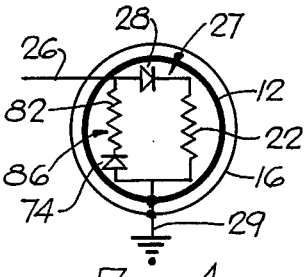

FIG. 4 shows another modified construction which is similar to that of FIG. 3 except that the Zener diode 72 is replaced with a passive identification impedance 82 illustrated as a resistance element. The second diode rectifier 74 is retained so as to exclude the firing current from the signal current path 86. With this construction, the identification resistor 82 can have a relatively low value, comparable to that of the igniter 22, without diverting any of the firing current from the firing current path 27. The rockets 12 of the modified construction shown in FIG. 4 can be employed in the system of FIG. 1. For the different types of rockets, the identification resistance 82 is given measurably different values.

The identification impedances may in some cases be reactive, with different reactance values for the different types of rockets or other ammunition. In that case, the reactance values are measured electrically by the measuring means.

It will be understood that the common ground of the firing circuits does not need to be structured ground, but may be wired in some cases. In some launchers, the "ground" or common electrical return terminal is wired and does not utilize the frame or structure of the launcher. In fact, some launchers, particularly those of the throw-away type, are not made of metal, but rather are made of an electrically insulating material such as plastic or compressed paper.

Thus, the ground connection of the firing circuit should be understood to contemplate the common return terminal of the circuit and may utilize wires or the structure of the launcher. Of course, both sides of each firing circuit may be wired independently, if desired.

As previously indicated, the computer 18 identifies all of the rockets 12 in the rocket launcher 14 and maintains a current inventory as to the various types of rockets which are available in the launcher. In addition, the computer 18 may be employed to select and fire one or more rockets of any desired type, under the control of the operator. For use in firing the rockets, the firing voltage may be supplied to the computer 18 by a connecting lead 90 extending to the computer 18 from the ungrounded terminal 46 of the firing voltage source 42. The computer 18 also has a ground connection to connect the computer to the grounded terminal 44 of the firing voltage source 42. To fire any particular rocket 12, the computer 18 may connect the firing voltage to the corresponding lead 68. The firing control switches 48 may also be incorporated into the computer 18 for use in firing the rockets 12. Thus, the switches 48 may be operated either manually or under the control of the computer 18.

The ammunition identification system 10 has an inherent self-testing feature which is unique, useful and highly advantageous. In addition to identifying the type of rocket or other ammunition by measuring the identification impedance 32, the system checks the continuity of the firing circuits 24 for all of the rockets 12. If any firing circuit 24 is open, the full voltage of the signal supply 58 will appear on the firing lead or wire 36, and also at the switch terminals 48 and 50, and will be shown by the measuring means 66. The existence of an open circuit will also be detected by the computer 18 and indicated by the display 20.

After the various rockets 12 have been loaded in the tubes 16 of the rocket launcher 14, the system 10 can be employed initially to check the continuity of all of the firing circuits 24. The system 10 will also detect the existence of a short circuit in any of the firing circuits 24. If a short circuit exists, the signal voltage will be zero, or virtually zero, on the firing lead 36 and also at the switch terminals 48 and 50.

The ability to detect open and short circuit conditions is a very valuable feature, because such conditions can arise at numerous points in the firing circuits, in the wiring on the helicopter or other vehicle between the control position and the rocket launchers, in the rocket launcher wiring, whereby the rockets are connected to the helicopter wiring, and in the rockets themselves. If an open or short-circuited condition is detected, the trouble can be remedied immediately.

The modification of FIG. 2 has the advantage that the system also checks the continuity of the igniter 22, which is effectively in series with the identification impedence 34. If the igniter 22 is open, the full signal voltage of the supply 58 will appear on the firing leads 26 and 36 and will be indicated by the measuring means 66 and by the computer 18.

In the embodiments of FIGS. 1, 3 and 4, the polarity of the signal supply 58, and also the polarity of the measuring means 66, may be reversed temporarily, so that the continuity of the igniters 22 can be checked. With this reversal, the signal current will flow through each diode rectifier 28 and corresponding igniter 22. As previously indicated, the signal current is limited to a low value which cannot possibly cause the igniter 22 to fire the rocket. If continuity exists in the igniter 22, a low voltage will appear on the firing lead 36 and will be indicated by the measuring means 66 and by the computer 18. If the igniter 22 is open, the full signal voltage will appear on the firing lead 36 and will be indicated by the measuring means 66 and the computer 18.

The ability of the system to test the firing circuits for continuity is important from a safety standpoint. The existence of continuity in any particular firing circuit gives assurance that the corresponding rocket is properly grounded and thus is safe from the hazards which arise when the rocket is not properly grounded. An ungrounded or improperly grounded rocket is vulnerable to accidental firing due to such factors as electrostatic charges, lightning and powerful radar beams. By establishing that continuity exists in the firing circuits for all of the rockets, the system gives the assurance that all of the rockets are properly grounded and free from the safety problems caused by ungrounded rockets.

I claim:

1. A system for identifying and firing ammunition,
comprising a round of ammunition having an igniter with a predetermined electrical resistance and operable by an electrical firing current,
a firing circuit for said igniter and having two electrical firing circuit terminals,
a diode rectifier,
a firing current path connecting said diode rectifier and said igniter in series between said firing circuit terminals,
said diode rectifier being capable of carrying a firing current of one polarity in said firing current path,
a firing voltage source for supplying the firing current of said polarity,
a signal source for supplying a signal current of opposite polarity relative to the polarity of said firing current,
said diode rectifier being nonconductive as to the signal current,
switching means for initially connecting said firing circuit to said signal source to identify the ammunition and for subsequently connecting said firing circuit to said firing voltage source to energize said igniter and thereby fire the round of ammunition,
said round of ammunition including an identification impedance having a nature to identify said ammunition,
said round of ammunition having a signal current path connecting said identification impedance to said firing circuit,
said signal current path being in parallel with at least a portion of said firing current path,
and measuring means connected to said firing circuit for measuring the impedance of said signal current path and thereby indicating the nature of said identification impedance to identify the ammunition.

2. A system according to claim 1,
in which said identification impedance includes an identification resistance having a value for identifying said ammunition,
said measuring means including means utilizing said signal current to measure the value of said identification resistance.

3. A system according to claim 1,
in which said identification impedance includes a Zener breakdown diode having a breakdown voltage to identify said ammunition,
said measuring means including means for utilizing the signal current to measure said breakdown voltage.

4. A system according to claim 3,
in which said signal current path includes a second diode rectifier in series with said Zener diode and having an opposite polarity relative to the polarity of the diode rectifier in said firing current path to exclude the firing current from said signal current path.

5. A system according to claim 1,
including a second diode rectifier in series with said signal current path and having an opposite polarity relative to the polarity of the diode rectifier in said firing current path to exclude the firing current from said signal current path.

6. A system according to claim 5,
in which said identification impedance comprises an identification resistance in series with said second diode rectifier and having a resistance value to identify said ammunition,
said measuring means including means for utilizing the signal current to measure the resistance value.

7. A system according to claim 1,
in which said signal current path is in parallel with said firing current path between said firing circuit terminals.

8. A system according to claim 7,
including a second diode rectifier in series with said signal current path to exclude the firing current from said signal current path,
said second diode rectifier having an opposite polarity relative to the polarity of the first mentioned diode rectifier in the firing current path.

9. A system according to claim 8,
in which said identification impedance includes a Zener breakdown diode in series with said second diode rectifier and having a breakdown voltage to identify said ammunition.

10. A system according to claim 8,
in which said identification impedance comprises an identification resistance having a resistance value to identify said ammunition.

11. A system according to claim 1,
in which said signal current path is connected in parallel with said diode rectifier whereby the signal current flows through said igniter but is excluded from said diode rectifier,
said signal source including current limit means for limiting the signal current through the igniter to a value which is insufficient to fire the ammunition.

12. A system according to claim 11,
in which said identification impedance comprises an identification resistance having a resistance value to identify the ammunition.

13. A system according to claim 12,
in which the resistance value of said identification resistance is substantially greater than the resistance of said igniter.

14. A system according to claim 12,
in which said measuring means includes means for utilizing the signal current to measure the combined resistance of said identification resistance and said igniter.

15. A system according to claim 1,
including a plurality of rounds of ammunition of the character specified, each round of ammunition having its own firing circuit, diode rectifier, firing current path, switching means, identification impedance and signal current path, said rounds of ammunition being of a plurality of different types, each type of ammunition having a distinctively different identification impedance to provide for the electrical identification of the type of ammunition in each firing circuit.

16. A system according to claim 15, in which the different types of ammunition have identification impedances with measurably different impedance values.

17. A system according to claim 15,
in which the identification impedances in the different types of ammunition have measurably different values of electrical resistance for identifying the different types of ammunition.

18. A system according to claim 15,
in which the different identification impedances of the different types of ammunition include breakdown diodes having measurably different values of breakdown voltage identifying the ammunition.

* * * * *